US005268262A

United States Patent [19]

Shibahara et al.

[11] Patent Number: 5,268,262

[45] Date of Patent: Dec. 7, 1993

[54] SILVER HALIDE PHOTOGRAPHIC MATERIAL

[75] Inventors: Yoshihiko Shibahara; Shinpei Ikenoue, both of Ashigara, Japan

[73] Assignee: Fuji Photo Film Co., Ltd., Kanagawa, Japan

[21] Appl. No.: 955,242

[22] Filed: Oct. 1, 1992

Related U.S. Application Data

[63] Continuation of Ser. No. 689,725, Sep. 6, 1990, abandoned, which is a continuation of Ser. No. 70,016, Jul. 6, 1987, abandoned.

[30] Foreign Application Priority Data

Jul. 4, 1986 [JP] Japan ..... 61-157656

[51] Int. Cl.[5] ..... G03C 1/035; G03C 1/46

[52] U.S. Cl. ..... 430/506; 430/567

[58] Field of Search ..... 430/567, 569, 506

[56] References Cited

U.S. PATENT DOCUMENTS

| | | | |
|---|---|---|---|
| 4,439,520 | 3/1984 | Kofron et al. | 430/569 |
| 4,446,226 | 5/1984 | Yamashita et al. | 430/567 |
| 4,585,729 | 4/1986 | Sugimoto et al. | 430/509 |
| 4,640,889 | 2/1987 | Komorita et al. | 430/567 |
| 4,640,890 | 2/1987 | Fujita et al. | 430/506 |
| 4,670,375 | 6/1987 | Michive et al. | 430/509 |
| 4,675,279 | 6/1987 | Shuto et al. | 430/567 |
| 4,686,176 | 8/1987 | Yagi et al. | 430/506 |
| 4,724,198 | 2/1988 | Yamada et al. | 430/506 |
| 4,775,617 | 10/1988 | Goda | 430/567 |

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A silver halide photographic material containing a support having provided thereon blue-sensitive, green-sensitive, and red-sensitive layers, in which at least the blue-sensitive layer is composed of at least two layers including a more sensitive layer and a less sensitive layer. The most sensitive layer of the blue-sensitive layer is a blue-sensitive layer containing an emulsion of substantially monodispersed grains, and at least one layer other than the most sensitive layer contains an emulsion containing tabular silver halide grains of about 5:1 or more in average aspect ratio. The material has superior sharpness and graininess, and is useful for color photography.

12 Claims, No Drawings

SILVER HALIDE PHOTOGRAPHIC MATERIAL

This is a continuation of application Ser. No. 07/689,725 field Sept. 6, 1990, now abandoned, which in turn is a Continuation of application Ser. No. 07/070,016, filed Jul. 6, 1987 now abandoned.

FIELD OF THE INVENTION

This invention relates to a silver halide color photographic material and, more particularly, to a silver halide color photographic material which has improved graininess and sharpness and which is suitable for photographing.

BACKGROUND OF THE INVENTION

In recent years, high sensitization and reduction in the size of silver halide color negative films have progressed so that color negative photographic light-sensitive materials having high sensitivity and providing excellent image quality have been eagerly required.

Many efforts have been made mainly to improve silver halide emulsions for meeting such requirements.

For example, U.S. Pat. Nos. 4,434,226, 4,414,310, 4,433,048, 4,414,306 and 4,459,353 disclose the use of tabular grains with the intention of improving sensitivity by improvement of the efficiency of color sensitization with sensitizing dyes, the relationship between sensitivity and graininess, sharpness, and covering power.

Japanese Patent Application (OPI) Nos. 113930/83 (corresponding to U.S. Pat. No. 4,439,520), 113934/83 (corresponding to U.S. Pat. No. 4,439,520) and 119350/84 (corresponding to European Patent 111,919) (the term "OPI" as used herein refers to a "published unexamined Japanese patent application") disclose multi-layer color photographic light-sensitive materials having high sensitivity and improved graininess, sharpness, and color reproducibility when a tabular silver halide emulsion of 8:1 or more in aspect ratio is used in more sensitive layers.

Further, Japanese Patent Application (OPI) No. 77847/86 discloses a multilayer color photographic light-sensitive material having improved sharpness and color reproducibility when a tabular silver halide emulsion of at least 5:1 in aspect ratio is used in a more sensitive layer and a monodispersed silver halide emulsion is used in a less sensitive layer.

As a result of investigations by the inventors, however, it has been determined that highly sensitive layers, particularly the most sensitive layer of a blue light-sensitive layer does not show satisfactory graininess when a tabular silver halide emulsion is used therein. This may be attributed to the fact that the great sensitization effect by dyes, which is the advantage of tabular grains, is not fully realized in the blue light-sensitive layer.

It is known that, in order to attain excellent photographic properties such as high sensitization, high contrast, and excellent graininess, monodispersed silver halide emulsions having a narrow grain distribution as described in, for example, Japanese Patent Application (OPI) No. 153428/77 (corresponding to U.S. Pat. No. 4,184,878) are advantageous. In addition, it is helpful for the core portion and the shell portion of the grains to both function as emulsion grains from light reception to image formation as much as possible, by using core/-shell emulsion grains which contain an internal phase having a different halide composition, to thereby increase the efficiency of using incident light.

Further, it is considered preferable to narrow the distribution of halide composition among grains to obtain highly contrasty emulsions.

However, monodispersed silver halide emulsions of some grain sizes can scatter incident light so much that, particularly when a less sensitive layer contains such a monodispersed emulsion, sharpness is unsatisfactorily reduced due to the scattering of light.

SUMMARY OF THE INVENTION

An object of the present invention is to provide a silver halide color photographic material having high sensitivity and good graininess and sharpness.

This object can be attained by a silver halide photographic material which comprises a support having provided thereon at least two blue-sensitive layers differing in light sensitivity, at least one green-sensitive layer, and at least one red-sensitive layer the most light-sensitive layer of the blue-sensitive layer containing a silver halide emulsion containing substantially monodispersed silver halide grains, and at least one layer other than the most sensitive blue-sensitive layer containing an emulsion containing tabular silver halide grains of at least about 5:1 in average aspect ratio.

DETAILED DESCRIPTION OF THE INVENTION

The silver halide photographic material of the present invention has a multilayer structure in which emulsion layers for recording blue, green, and red light, respectively, containing a binder and silver halide grains are superposed one over the other, and at least one of the emulsion layers contains a more sensitive layer and a less sensitive layer. Useful layer structures are illustrated below, although the present invention is not limited thereto.

(1) BH/BL/GH/GL/RH/RL/S
(2) BH/BL/GH/RH/GL/RL/S
(3) BH/BM/BL/GH/GM/GL/RH/RM/RL/S
(4) BH/GH/RH/BL/GL/RL/S
(5) BH/BL/GH/RH/GM/GL/RM/RL/S
(6) BH/BL/GH/GL/RH/RM/RL/S
(7) BH/BL/GH/GM/GL/RH/RL/S
(8) BH/BM/BL/GH/GL/RH/RL/S
(9) BH/BL/GH/GM/GL/RH/RM/RL/S
(10) BH/BM/BL/GH/GM/GL/RH/RL/S
(11) BH/BM/BL/GH/GL/RH/RM/RL/S
(12) BH/GH/RH/BL/GM/GL/RL/S
(13) BH/GH/RH/BM/BL/GM/GL/RM/RL/S
(14) BH/GH/RH/BL/GL/RM/RL/S
(15) BH/GH/R1/BM/BL/GL/RL/S

In the above illustration, structures (1) to (5) are preferred.

In the above illustration, B represents a blue-sensitive layer, G represents a green-sensitive layer, R represents a red-sensitive layer, H represents the most sensitive layer, M represents a medium sensitivity layer, L represents a low sensitivity layer, and S represents a support, with light-insensitive layers such as protective layers, filter layers, interlayers, antihalation layers, subbing layers, etc., being omitted. Of these, structures (1) and (3) are particularly preferred.

In layer structure (1), monodispersed silver halide grains (hereinafter abbreviated as "monodispersed grains") are used in BH, and tabular silver halide grains of 5:1 or more in average aspect ratio (hereinafter abbreviated as "tabular grains") are used in light-sensitive layers other than BH. As a layer containing tabular silver halide grains, BL is particularly desirable. More preferably, the tabular silver halide grains are also used in GH and/or GL.

With layer structure (1), a desirable combination of the emulsions is as follows:

| Layer | BH | BL | Other Layers |
|---|---|---|---|
| Kind of Emulsion | Monodispersed Grains | Tabular Grains | Any Grains |

With the layer structure (1), a more desirable combination of the emulsions is as follows:

| Layer | BH | BL | GH | RH | Other Layers |
|---|---|---|---|---|---|
| Kind of Emulsion | Mono-dispersed Grains | Tabular Grains | Tabular Grains | Mono-dispersed Grains | Any Grains |

In either case, tabular grains are preferably not used in RH and RL.

With layer structure (3), a desirable combination of emulsions is as follows:

| Layer | BH | BL | Other Layers |
|---|---|---|---|
| Kind of Emulsion | Monodispersed Grains | Tabular Grains | Any Grains |

With the layer structure (3), a more desirable combination of the emulsions is as follows:

| Layer | BH | BM | BL | GH | RH | Other Layers |
|---|---|---|---|---|---|---|
| Kind of Emul-sion | Mono-dis-persed Grains | Mono-dispersed Grains | Tabular Grains | Tabular Grains | Mono-dis-persed Grains | Any Grains |

If regions A and B represent depthwise equal regions between the support and the farthest emulsion layer C from the support, with region A being further from the support than region B, then it is preferred that BH positioned at the greatest distance from the support contain monodispersed grains, that at least one layer containing tabular grains exist in region A, and that at least one layer containing monodispersed grains exist in region B. Further, it is more preferred that BH positioned at the greatest distance from the support contain monodispersed grains, that all layers other than BH in region A contain tabular grains, and that all layers in region B contain monodispersed grains.

The light-scattering properties of emulsion grains generally depend upon their grain size, form, halide composition, etc. With emulsions of a monodispersed grain size distribution, the scattering of light by grains becomes comparatively small when average size exceeds about 0.8 μm. Since grains of about 0.8 μm or more in average grain size are often used in the emulsion layer positioned at the greatest distance from the support (e.g., corresponding to BH in ordinary color negative light-sensitive materials), it is advantageous from the standpoint of sharpness to use monodispersed grains that are at least about 0.8 μm in size. In addition, since BH is a layer particularly contributing to graininess, monodispersed grains with excellent graininess be preferably used therein. In region A, it is advantageous from the standpoint of sharpness to use tabular grains scattering less light, even when the tabular grains have an average grain size of not more than about 0.8 μm. On the other hand, the use of tabular grains in region B reduces MTF (Modulation Transfer Function) of low frequency, resulting in deterioration of sharpness. This may be attributed to the fact that, while tabular grains scatter less light for incident light vertical to their parallel planes, the light-scattering tendency increases as the angle of incident light deviates from the vertical angle, and, hence, in region A wherein the proportion of perpendicular light is predominant, tabular grains show a smaller light-scattering tendency than non-tabular grains but, in region B wherein the proportion of diffused light is increased as a result of scattering in the upper layer, tabular grains have a somewhat greater light-scattering tendency than non-tabular grains. Therefore, in region B, it is desirable not to use tabular grains but to use monodispersed grains while avoiding the size region significantly scattering light as much as possible.

These effects can be increased to an unexpected degree by the proper combination of layer composition and order.

In the silver halide photographic material of the present invention, the most sensitive layer of the blue-sensitive layer contains an emulsion comprising substantially monodispersed silver halide grains.

In the present invention, the term "substantially monodispersed silver halide grains" means emulsions in which about 60% or more, preferably about 70% or more, particularly preferably about 80% or more, of all silver halide grain weight has a size falling within the range of about ±20% of the average grain size $\bar{r}$.

The term "average grain size $\bar{r}$" as used herein means a diameter determined as the $r_i$ which has the maximum value for $n_i \times r_i^3$ when $n_i$ represents the number of grains having a size of $r_i$ (to three significant digits with rounding off the minimum digit).

With spherical silver halide grains, the term "grain size" as used herein means the diameter and, with grains of other than spherical shape, the diameter of a sphere equal in volume.

As the silver halide grains to be used in the most sensitive layer of the blue-sensitive layer of the present invention, core/shell type emulsions are preferable. Emulsions containing core/shell type normal crystals can be prepared by adding, to a gelatin solution containing seed grains of normal crystals, both a solution of water-soluble silver salt and a solution of water-soluble halide according to the double jet process, while controlling pAg and pH. The addition rates of these solutions may be determined by the methods disclosed in Japanese Patent Application (OPI) Nos. 48521/79 and 49938/83.

Emulsions containing core/shell type twin crystals may be prepared by the methods disclosed, for example, in Japanese Patent Application (OPI) No. 118823/79. In such processes silver iodide nuclei are formed in the initial stage and a solution of water-soluble silver salt and a solution of water-soluble halide are added thereto to cause a conversion reaction and form cores containing silver iodobromide.

Emulsions of core/shell type twin crystals may also be prepared by ripening a multiple twin crystal emulsion in the presence of a silver halide solvent to form a monodispersed spherical seed emulsion, and growing the seed emulsion according to the double jet process.

In the present invention, silver bromide, silver iodide, and silver iodobromide may be used as the silver halide for the more sensitive layer, with silver iodobromide being particularly preferred. A slight amount of silver chloride may be present as long as it does not adversely affect the photographic properties of the emulsion.

Silver halide grains for the more sensitive layer preferably used in the present invention are those which have a grain structure containing two or more layers different from each other in silver iodide content, with the outermost layer (shell portion) preferably having a lower silver iodide content than the inner layer(s) (core portion). The silver iodide content in the core portion may range from about 5 to 40 mol %, but is preferably from about 15 to 40 mol %, and more preferably from about 25 to 40 mol %. On the other hand, the silver iodide content in the shell portion is less than about 5 mol %, and preferably from about 0.5 to 4.0 mol %.

In the present invention, the silver iodide content may change sharply or may change continuously without a sharp change at the boundary between the core portion having a higher silver iodide content and the shell portion having a lower silver iodide content in the silver halide grains for the more sensitive layer. To produce a continuously changing halide composition at the boundary between the core portion and the shell portion, there may be employed a process of gradually changing the composition of the halide solution to be added in the double jet process. In addition, the silver iodide composition may be localized to some extent in both the core portion and the shell portion.

In the core/shell type silver halide grains, the shell portion accounts for about 10 to 80%, preferably about 15 to 70%, and more preferably about 20 to 60%, of the grain.

The monodispersed emulsion of the present invention has a relatively standard deviation of individual grain sizes of not more than about 20%, more preferably not more than about 12%, measured according to the method described in, for example, European Patent 147,868.

The substantially monodispersed silver halide grains to be used in the present invention may have a normal crystal form such as a cubic, tetradecahedral or octahedral form or may be twin crystals, or may be in a mixed form thereof. Normal crystals are preferred, with regular octahedral crystals being most preferred.

The average grain size of the monodispersed silver halide grains to be used in the most sensitive layer of blue-sensitive layer of the present invention is preferably about 0.6 μm or larger, more preferably about 0.8 μm to 1.8 μm, from the standpoint of graininess and sharpness.

In the silver halide photographic material of the present invention, at least one layer chosen from a blue-sensitive layer other than the most sensitive layer, a green-sensitive layer, and a red-sensitive layer contains an emulsion containing tabular silver halide grains of about 5:1 or more in average aspect ratio. It is preferable that at least a less sensitive layer of the blue-sensitive layer contain the tabular silver halide grain emulsion. The term "aspect ratio" as used herein means the ratio of diameter to thickness of grain. The term "diameter of grain" as used herein means the diameter of a circle having the same projected area as the grain. Silver halide grains (tabular silver halide grains) to be used in the present invention preferably have an aspect ratio of about 5 to 100, more preferably of about 5 to 50, and particularly preferably of about 5 to 20.

In the present invention, the tabular silver halide grains are about 0.5 to 15.0 μm, preferably about 1.0 to 10.0 μm in diameter.

The layer containing tabular silver halide grains of the present invention contains the tabular grains in an amount of preferably about 40% by weight or more, particularly preferably about 60% by weight or more, based on all silver halide grains in the layer.

When the tabular grains to be used in the present invention are not subjected to sensitization by allowing epitaxial growth of a different silver salt on the surface of the grains, the tabular silver halide grains preferably contain silver bromide and silver iodobromide, with silver iodobromide containing 0 to about 15 mol % of silver iodide being more preferred.

A particularly preferred silver iodide content is about 4 to 10 mol %.

As to the internal grain structure, the tabular silver iodobromide grains preferably have a structure with a central region between the first and second main parallel planes and an outer region between the central region and the grain surface, with the central region and the outer region having different iodide contents. More preferably, the iodide content of the outer region is lower than that of the central region. The outer region preferably surrounds the central region so as to form an annular ring direction. The change in iodide content at the boundary between the central region and the outer region may be sharp or may change continuously with no sharp differentiation.

As to processes for preparing tabular silver halide grains having such an internal distribution of halide composition, reference may be made to Japanese Patent Application (OPI) Nos. 15428/77, 118823/79, 113927/83 and 99433/84.

The tabular silver halide grains in accordance with the present invention may be polydispersed or monodispersed, with monodispersed grains being more preferred.

As a preferred process for obtaining an emulsion comprising monodispersed tabular grains, a process of ripening nuclear grains composed of multiple twin crystals in the presence of a silver halide solvent to prepare seeds composed of monodispersed spherical grains, then growing the seeds may be employed. In a more preferred process, a tetraazaindene compound may be present during growth of the tabular grains to thereby raise the proportion of tabular grains and improve monodispersion.

When sensitizing tabular silver halide grains to be used in the present invention by allowing a different silver halide to epitaxially grow on the surface of the grains, above-described tabular crystals may be used as host crystals, or tabular grains composed of pure silver iodide may be used as host crystals. As silver halide used for the epitaxial growth, silver bromide, silver chloride, or silver chlorobromide may be used, with silver bromide being particularly preferred. Silver halide in the epitaxial growth portion may contain silver iodide in an amount of up to about 5 mol %.

In the tabular epitaxial silver halide grains used in the present invention, the epitaxial crystal portion accounts for preferably about 5 to 30 mol %, particularly preferably about 10 to 20 mol %, based on the mol amount of all silver halide in the grain.

Epitaxial growth on the epitaxial tabular silver halide grains to be used in the present invention is preferably selectively located on limited portions of the silver halide surface, for example, the edges, corners, or rim thereof, etc. Such silver halide emulsions may be prepared according to the processes described in Japanese Patent Application (OPI) Nos. 108526/83, 119350/84 and 133540/84.

In the photographic emulsion layers of the photographic light-sensitive material according to the present invention, any of silver bromide, silver iodobromide,-silver iodochlorobromide, silver chlorobromide, and silver chloride may be used as well as the above-mentioned emulsions. Preferred silver halide is silver iodobromide or silver iodochlorobromide containing up to about 30 mol % of silver iodide, with silver iodobromide containing about 2 mol % to about 25 mol % of silver iodide being particularly preferred.

Silver halide grains in the photographic emulsion may be regular grains having a regular form such as a cubic, octahedral or tetrahedral form, may have an irregular form such as a spherical form, may have a crystal defect such as a twin plane structure, or may have a mixed form thereof.

The silver halide grains may be fine grains of up to about 0.1 μm or large grains of up to about 10 μm in projected area diameter, and may be monodispersed with a narrow size distribution or polydispersed with a broad size distribution.

The silver halide photographic emulsion used in the present invention may be prepared according to known processes described in, for example, *Research Disclosure* (RD), No. 17643 (December, 1978), pp. 22-23, "I. Emulsion preparation and types and ibid., No. 18716 (November, 1979), p. 648.

The photographic emulsion to be used in the present invention can be prepared by the processes described in P. Glafkides, *Chimie et Physique Photographique*, pp. 329 to 425 (Paul Montel, 1967), G. F. Duffin, *Photographic Emulsion Chemistry*, pp. 57 to 82 (Focal Press, 1966), V. L. Zelikman et al., *Making and Coating Photographic Emulsion*, pp. 69 to 87 (Focal Press, 1964). That is, any of an acidic process, a neutral process, and an ammonia process can be used. In reacting a soluble silver salt with a soluble halide salt, any of a single jet process, a double jet process, and combinations thereof may be employed. A process of forming grains in the presence of excess silver ions (a "reverse mixing process") can be employed as well. As one double jet process, a "controlled double jet process" wherein the pAg in the liquid phase in which silver halide is formed is kept constant can be employed. This process provides a silver halide emulsion containing silver halide grains of regular crystal form having an approximately uniform grain size.

Two or more silver halide emulsions separately prepared may be mixed for use in the invention material.

Silver halide emulsions containing the aforementioned regular grains may be obtained by controlling the pAg and pH during the formation of the grains. Detailed descriptions are given in, for example, *Photographic Science and Engineering*, Vol. 6, pp. 159 to 165 (1962), *Journal of Photographic Science*, Vol. 12, pp. 242 to 251 (1964), U.S. Pat. No. 3,655,394 and British Patent 1,413,748.

The emulsions used in the present invention are usually subjected to physical ripening, chemical ripening, and spectral sensitization, and additives to be used in these steps are described in *Research Disclosure*, No. 17643 and No. 18716 in the places indicated in the following Table, along with known photographic additives that can be used in the present invention.

| | Kind of Additive | RD 17643 | RD 18716 |
|---|---|---|---|
| 1 | Chemical Sensitizing Agent | page 23 | page 648, right column |
| 2 | Sensitizing Agent | | " |
| 3 | Spectral Sensitizing Agent and Supersensitizing Agent | Pages 23-24 | page 649, right column |
| 4 | Brightening Agent | page 24 | |
| 5 | Antifoggant and Stabilizer | pages 24-25 | page 649, right column |
| 6 | Light Absorbent, Filter Dye and UV Light Absorbent | pages 25-26 | page 649, right column to page 650, left column |
| 7 | Stain Preventing Agent | page 25, right column | page 650, left to right columns |
| 8 | Dye Image Stabilizer | page 25 | |
| 9 | Hardener | page 26 | page 651, left column |
| 10 | Binder | page 26 | " |
| 11 | Plasticizer and Lubricant | page 27 | page 650, right column |
| 12 | Coating Aid and Surfactant | pages 26-27 | " |
| 13 | Antistatic Agent | page 27 | " |

Dyes of the following general formula (I) as described, e.g., in Japanese Patent Application (OPI) No. 116645/84 may be used in the blue-sensitive layer, and use of these dyes is particularly preferred when tabular grains are used in the blue-sensitive layer.

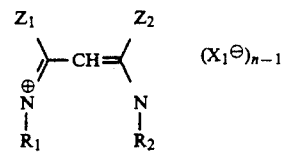

(I)

In the above formula, $Z_1$ and $Z_2$, which may be the same or different, each represents an atomic group necessary for completing a thiazole ring, a benzothiazole ring, a naphthothiazole ring, a selenazole ring, a benzoselenazole ring, a naphthoselenazole ring, an imidazole ring, a benzimidazole ring, a naphthoimidazole ring, an oxazole ring, a benzoxazole ring, a naphthoxazole ring, a pyridine ring, or a quinoline ring;

at least one of $R_1$ and $R_2$ represents an alkyl group substituted with a carboxyl group or a sulfo group and, when one of $R_1$ and $R_2$ represents an alkyl group substituted with a carboxyl, group or a sulfo group, the other represents an unsubstituted group;

$X^{\theta}$ represents an anion; and n represents 1 or 2 and, when the sensitizing dye represented by the general formula (I) forms an inner salt, n represents 1.

Examples of particularly preferred compounds of formula (I) are illustrated below.

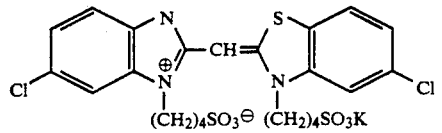

-continued

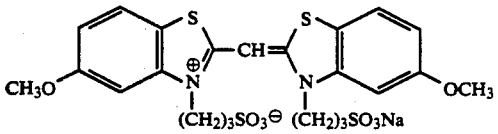

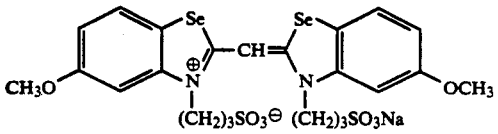

The dyes are used in an amount of preferably about $5\times10^{-5}$ to $2\times10^{-3}$, more preferably about $2\times10^{-4}$ to $7\times10^{-4}$ mol, per mol of silver halide.

Various color couplers may be used in the present invention. Specific examples thereof are described in the patents referred to in the above-mentioned *Research Disclosure* (RD) No. 17643, VII-C to G. As dye-forming couplers, those couplers which provide the three primary colors of subtractive color photography (i.e., yellow, magenta, and cyan) upon color development processing are important. As diffusion resistant, 4- or 2-equivalent couplers, the following are preferably used, as well as those described in RD 17643, VII-C and D.

As yellow couplers to be used in the present invention, hydrophobic acylacetamide couplers having a ballast group are typical examples. Specific examples thereof are described in U.S. Pat. Nos. 2,407,210, 2,875,057 and 3,265,506. The use of 2-equivalent couplers is preferred in the present invention, and typical examples thereof include yellow couplers of the oxygen atom coupling-off type described in U.S. Pat. Nos. 3,408,194, 3,447,928, 3,933,501 and 4,022,620, and yellow couplers of the nitrogen atom coupling-off type described in Japanese Patent Publication No. 10739/83, U.S. Pat. Nos. 4,401,752, 4,326,024, RD 18053 (April, 1979), British Patent 1,425,020, West German Patent Application (OLS) Nos. 2,219,917, 2,261,361, 2,329,587 and 2,433,812. α-Pivaloylacetanilide type couplers are excellent in fastness, particularly light fastness, of the colored dyes produced, while α-benzoylacetanilide type couplers provide high color density.

Magenta couplers to be used in the present invention include hydrophobic, ballast group-containing indazolone or cyanoacetyl, preferably 5-pyrazolone and pyrazoloazole couplers. Of 5-pyrazolone couplers, those which are substituted by an arylamino group or an acylamino group in the 3-position are preferred in view of hue and the color density of colored dyes produced. Typical examples thereof are described in U.S. Pat. Nos. 2,311,082, 2,343,703, 2,600,788, 2,908,573, 3,062,653, 3,152,896 and 3,936,015. As coupling-off groups for 2-equivalent 5-pyrazolone couplers, the nitrogen atom coupling-off groups described in U.S. Pat. No. 4,310,619 and arylthio groups described in U.S. Pat. No. 4,351,897 are particularly preferred. Ballast group-containing 5-pyrazolone couplers described in European Patent 73,636 provide high color density. Pyrazoloazole couplers include pyrazoldbenzimidazoles described in U.S. Pat. No. 3,061,432; preferably pyrazolo[5,1-c][1,2,4]triazoles described in U.S. Pat. No. 3,725,067; pyrazolotetrazoles described in *Research Disclosure,* No. 24220 (June, 1984) and Japanese Patent Application (OPI) No. 33552/85; and pyrazolopyrazoles described in *Research Disclosure,* No. 24230 (June, 1984) and Japanese Patent Application (OPI) No. 43659/85. Imidazo[1,2-b]pyrazoles described in U.S. Pat. No. 4,500,630 are preferred for limited side yellow absorption by the dyes formed, and pyrazolo[1,5-b][1,2,4]-triazoles described in U.S. Pat. No. 4,540,654 are particularly preferred.

Cyan couplers used in the present invention include hydrophobic, diffusion resistant naphtholic and phenolic couplers. Typical examples thereof include naphtholic couplers described in U.S. Pat. No. 2,474,293, preferably oxygen atom coupling-off type 2-equivalent naphtholic couplers described in U.S. Pat. Nos. 4,052,212, 4,146,396, 4,228,233 and 4,296,200. Specific examples of the phenolic couplers are described in U.S. Pat. Nos. 2,369,929, 2,801,171, 2,772,162 and 2,895,826.

Couplers capable of forming cyan dyes fast against high humidity and high temperatures are preferably used in the present invention, and typical examples thereof include phenolic cyan couplers having an alkyl group with at least two carbon atoms at the m-position of the phenol nucleus, described in U.S. Pat. No. 3,772,002; 2,5-diacylamino-substituted phenolic couplers described in U.S. Pat. Nos. 2,772,162, 3,758,308, 4,126,396, 4,334,011, 4,327,173, West German Patent Application (OLS) No. 3,329,729 and European Patent 121,365; and phenolic couplers having a phenylureido group in the 2-position and an acylamino group in the 5-position, described in U.S. Pat. Nos. 3,446,622, 4,333,999, 4,451,559 and 4,427,767. Naphthoic cyan couplers having a sulfonamido group, an amido group in the 5-position described in European Patent 161,626A are also preferably used in the present invention, since they form color images with excellent fastness.

In order to reduce the undesired absorption of colored dyes, colored couplers are preferably used in combination with the above couplers in color light-sensitive materials for photographic use. Typical examples thereof include yellow-colored magenta couplers described in U.S. Pat. No. 4,163,670 and Japanese Patent Publication No. 39413/82; and magenta-colored cyan couplers described in U.S. Pat. Nos. 4,004,929, 4,138,258 and British Patent 1,146,368. Other colored couplers are described in the foregoing RD 17643, VII-G.

Graininess can be improved by using those couplers which form dyes with a proper diffusibility. U.S. Pat. No. 4,366,237 and British Patent 2,125,570 describe specific examples of such magenta couplers, and European Patent 96,570 and West German Patent Application (OLS) No. 3,234,533 describe specific examples of such yellow, magenta, or cyan couplers.

The dye-forming couplers and the above-described special couplers may be in the form of a dimer or higher polymer. Typical examples of polymerized dye-forming couplers are described in U.S. Pat. Nos. 3,451,820 and 4,080,211. Specific examples of polymerized magenta couplers are described in British Patent 2,102,173 and U.S. Pat. No. 4,367,282.

Couplers which release a photographically useful residue upon coupling are also preferably used in the present invention. As DIR couplers capable of releasing a development inhibitor, those which are described in the patents referred to in the foregoing RD 17643, VII-F are useful.

Those which are suitably used in the present invention include developer-deactivatable couplers such as those described in Japanese Patent Application (OPI) No. 151944/82; timing type couplers such as those described in U.S. Pat. No. 4,248,962 and Japanese Patent Application (OPI) No. 154234/82; and reaction type couplers such as those described in Japanese Patent Application (OPI) No. 184248/85; with developer-deactivatable DIR couplers described in Japanese Patent Application (OPI) Nos. 151944/82, 217932/83, 218644/85, 21750/85, 225156/85 and 233650/85, and reaction type DIR couplers described in Japanese Patent Application (OPI) No. 184248/85 being particularly preferred. From the standpoint of enhancing the improvement of sharpness by the combination of tabular grains and monodispersed grains, timing type DIR couplers having a coupling-off group with a large diffusibility are particularly desirable.

In the light-sensitive material of the present invention, couplers which imagewise release a nucleating agent or a development accelerator or a precursor thereof upon development may be used. Specific examples of such compounds are described in British Patents 2,097,140 and 2,131,188. Couplers capable of releasing a nucleating agent or the like capable of adsorbing onto silver halide grains are particularly preferred, and specific examples thereof are described in Japanese Patent Application (OPI) Nos. 157638/84 and 170840/84.

The couplers used in the present invention may be introduced into light-sensitive materials according to various known dispersion processes such as a solid dispersion process, an alkali dispersion process, a latex dispersion process (preferred), an oil-in-water dispersion process (more preferred), etc. In the oil-in-water dispersion process, couplers are dissolved in a single solvent or a mixed solvent containing high boiling organic solvents having a boiling point of about 175° C. or higher and low boiling solvents called auxiliary solvents, and the resulting solution is finely dispersed in water or an aqueous medium such as a gelatin aqueous solution in the presence of a surface active agent. Examples of the high boiling organic solvents are described in U.S. Pat. No. 2,322,027. The dispersing procedure may be accompanied by phase inversion. If desired, the auxiliary solvent may be removed partly or wholly from the coupler dispersion before coating, by distillation, noodle washing with water, ultrafiltration, or the like.

The steps and effects of the latex dispersion process and specific examples of latexes for impregnation are described in U.S. Pat. No. 4,199,363, West German Patent Application (OLS) Nos. 2,541,274 and 2,541,230.

Suitable supports used in the present invention are described in, for example, the foregoing RD No. 17643, p. 28 and ibid., No. 18716, p. 647, right column to p. 648, left column.

The color photographic materials in accordance with the present invention may be developed in any conventional manner described in the foregoing RD No. 17643, pp. 28–29 and ibid., No. 18716, p. 651, left column to right column.

The color developer to be used in the present invention is preferably an alkaline aqueous solution containing an aromatic primary amine color developing agent as a main ingredient. As color developing agents, p-phenylenediamine compounds are preferably used, though aminophenolic compounds are also useful. Typical examples thereof include 3-methyl-4-amino-N,N-diethyl-aniline, 3-methyl-4-amino-N-ethyl-N-β-hydroxyethylaniline, 3-methyl-4-amino-N-ethyl-N-β-methanesulfonamidoethyl-aniline, 3-methyl-4-amino-N-ethyl-N-β-methoxyethylaniline, and sulfates, hydrochlorides or p-toluenesulfonates thereof. Generally, salts of these diamines are more stable than the free diamines, and they are preferably used in the salt form.

The color developer generally contains a pH buffer agent such as an alkali metal carbonate, borate or phosphate, a development inhibitor or antifoggant such as a bromide, an iodide, a benzimidazole, a benzothiazole or a mercapto compound. If desired, to the color developer may be added a preservative such as hydroxylamine or sulfite; an organic solvent such as triethanolamine or diethylene glycol; a development accelerating agent such as benzyl alcohol, polyethylene glycol, a quaternary ammonium salt or an amine; a dye-forming coupler; a competing coupler; a nucleating agent such as sodium borohydride; an auxiliary developing agent such as 1-phenyl-3-pyrazolidone; a viscosity-imparting agent; various chelating agents such as aminopolycarboxylic acids, aminopolyphosphonic acids, alkylphosphonic acids and phosphonocarboxylic acids; antioxidants described in West German Patent Application (OLS) No. 2,622,950, and the like.

In development processing of reversal color light-sensitive materials, usually black-and-white development is conducted before color development. In this black-and-white development may be used known black-and-white developing agents such as dihydroxybenzenes (e.g., hydroquinone), 3-pyrazolidones (e.g., 1-phenyl-3-pyrazolidone) and aminophenols (e.g., N-methyl-p-aminophenol), alone or as a combination thereof.

Color-developed photographic emulsion layers are usually bleached, and bleaching may be conducted independently or simultaneously with fixing. In order to accelerate the processing, bleach-fixing may be conducted after bleaching. As the bleaching agents, compounds of polyvalent metals such as iron (III), cobalt (III), chromium (VI), copper (II), etc., peracids, quinones, nitroso compounds, etc., are used. Typical bleaching agents include ferricyanides; dichromates; organic complex salts of iron (III) or cobalt (III), for example, complex salts of aminopolycarboxylic acids such as ethylenediaminetetraacetic acid, diethylenetriaminepentaacetic acid, nitrilotriacetic acid and 1,3-diamino-2-propanoltetraacetic acid, or of organic acids such as citric acid, tartaric acid or malic acid; persulfates; manganates; and nitrosophenols. Of these, iron (III) ethylcnediaminetetraacetate, iron (III) diethylenetriaminepentaacetate, and persulfates are particularly preferred in view of rapid processing and prevention of environmental pollution. Further, iron (III) ethylenediaminetetraacetate complex salt is particularly useful in both an independent bleaching solution and a monobath blix solution.

The bleaching solution, bleach-fixing solution or prebath thereof may contain, if desired, a bleaching accelerator. Specific examples of useful bleaching accelerators include mercapto or disulfido group-containing compounds described in U.S. Pat. No. 3,893,858, West German Patents 1,290,812, 2,059,988, Japanese Patent Application (OPI) Nos. 32736/78, 57831/78, 7418/78, 65732/78, 72623/78, 95630/78, 95631/78, 04232/78, 124424/78, 141623/78, 28426/78, and *Research Disclosure*, No. 17129 (July, 1978); thiazolidine derivatives as described in Japanese Patent Application (OPI) No. 140129/75; thiourea derivatives described in Japanese Patent Publication No. 8506/70, Japanese Patent Application (OPI) Nos. 20832/77 and 32735/78, and U.S. Pat. No. 3,706,561; iodides described in West German Patent 1,127,715 and Japanese Patent Application (OPI) No. 16235/83; polyethylene oxides described in West German Patents 966,410 and 2,748,430; polyamine compounds described in Japanese Patent Publication No. 8836/70; compounds described in Japanese Patent Application (OPI) Nos. 42434/74, 59644/74, 94927/78, 35727/79, 26506/80 and 163940/83; and iodide or bromide ions. Of these, the compounds having a mercapto group or a disulfide group are preferred from the viewpoint of their large accelerating effect, and the compounds which are described in U.S. Pat. No. 3,893,858, West German Patent 1,290,812 and Japanese Patent Application (OPI) No. 95630/78 are particularly preferred. Further, those compounds which are described in U.S. Pat. No. 4,552,834 are also preferred. These bleaching accelerators may be added to light-sensitive materials. These accelerators are particularly effective for bleach-fixing color light-sensitive materials for photographic use.

Fixing agents include thiosulfates, thiocyanates, thioether compounds, thioureas and a large concentration of iodide, with the use of thiosulfates being popular. As preservatives for the bleach-fixing solution or fixing solution, sulfites, bisulfites, or carbonyl-bisulfurous acid adducts are preferably used.

After the bleach-fixing or fixing procedure, water washing and stabilizing are typically conducted. In the water washing and stabilizing baths, various known compounds may be added for the purpose of preventing precipitation or saving water. For example, in order to prevent precipitation, water softeners such as inorganic phosphoric acid, aminopolycarboxylic acids, organopolyphosphonic acid, and organophosphoric acids; antibacterial agents and antifungal agents for preventing growth of various bacteria, algae, and fungi; metal salts represented by magnesium salts, aluminum salts, and bismuth salts; and surfactants for reducing drying load or preventing drying unevenness may be added as desired. Those compounds which are described in L. E. West, *Phot. Sci. Eng.*, Vol. 6, pp. 344–359 (1965) may also be added. Of these, chelating agents and antifungal agents are particularly effective.

The water washing step is generally conducted by countercurrent washing using two or more baths to save water. Further, in place of the water washing step, a multistage countercurrent stabilization processing step as described in Japanese Patent Application (OPI) No. 8543/82 may be employed. In this step, two to nine countercurrent baths are necessary. Various compounds are added to the stabilizing baths in addition to the above-described additives, for the purpose of stabilizing images. For example, typical examples include various buffers for adjusting film pH to, for example, about 3 to 9 (for example, borates, metaborates, borax, phosphates, carbonates, potassium hydroxide, sodium hydroxide, aqueous ammonia, monocarboxylic acid, dicarboxylic acid, polycarboxylic acid, etc., being used in combination), and aldehydes such as formalin. In addition, various additives such as chelating agents (e.g., inorganic phosphoric acids, aminopolycarboxylic acids, organophosphoric acids, organophosphonic acids, aminopolyphosphonic acids, phosphonocarboxylic acids, etc.), antibacterial agents (e.g., benzoisothiazolinone, isothiazolone, 4-thiazolinebenzimidazole, halogenated phenol, sulfanylamide, benzotriazole, etc.), surfactants, brightening agents, hardeners, or other conventional additives may be used as desired. Two or more compounds for the same or different purposes may be used in combination.

Further, the addition of various ammonium salts such as ammonium chloride, ammonium nitrate, ammonium sulfate, ammonium phosphate, ammonium sulfite, ammonium thiosulfate, etc., as agents for adjusting the pH of processed film is preferred.

With color light-sensitive materials for photographic use, the (washing stabilizing) step commonly conducted after fixing may be replaced by the aforesaid stabilizing step and washing step (water saving processing). In this case, formalin in the stabilizing bath may be omitted when the magenta coupler is of 2-equivalent type.

Water washing time and stabilizing time required in the present invention vary depending upon the kind of light-sensitive material and processing conditions, but are usually each about 20 seconds to 10 minutes, preferably about 20 seconds to 5 minutes.

The silver halide color photographic material of the present invention may contain a color developing agent for the purpose of simplifying and shortening the processing. For this purpose, various precursors of color developing agents are preferably used, including various salt type precursors described in Japanese Patent Application (OPI) Nos. 6235/81, 16133/81, 59232/81, 67842/81, 83734/81, 83735/81, 83736/81, 89735/81, 81837/81, 54430/81, 106241/81, 107236/81, 97531/82 and 83565/82; as well as indoaniline compounds described in U.S. Pat. No. 3,342,597; Schiff base type compounds described in U.S. Pat. No. 3,342,599 and *Research Disclosure*, Nos. 14850 and 15159; aldol compounds described in ibid., 13924; metal salt complexes described in U.S. Pat. No. 3,719,492, and urethane compounds described in Japanese Patent Application (OPI) No. 135628/78.

The silver halide color photographic material of the present invention may contain, if desired, various 1-phenyl-3-pyrazolidones for the purpose of promoting color development. Typical examples thereof are described in Japanese Patent Application (OPI) Nos. 64339/81, 144547/82, 211147/82, 50532/83, 50536/83, 50533/83, 50534/83, 50535/83 and 115438/83.

In the present invention, the various processing solutions are used at temperatures ranging from about 10° C. to 50° C. Temperatures of about 33° C. to 38° C. are standard, but higher temperatures may be employed for accelerating the processing and shortening processing time, or lower temperatures may be employed for improving image quality or stability of the processing solutions. In order to reduce the silver required in light-sensitive materials, processing involving cobalt intensification or hydrogen peroxide intensification described in West German Patent 2,226,770 or U.S. Pat. No. 3,674,499 may be conducted.

Each processing bath may have, if desired, a heater, a temperature sensor, a liquid level sensor, a circulating pump, a filter, a floating lid, a squeeger, or other conventional apparatus.

In continuous processing, consistent results can be obtained by preventing fluctuation of solution composition by using a replenisher for each processing solution. The replenishing amount may be reduced to a half of the standard replenishing amount or less to reduce costs.

The present invention is now illustrated in greater detail by reference to the following examples which, however, are not to be construed as limiting the present invention in any way. Unless otherwise indicated, all parts, percents and ratios are by weight.

EXAMPLE 1

Layers having respectively the following formulations were coated in order on a subbed cellulose triacetate film support to prepare Multilayer Color Light-Sensitive Materials 101 to 110.

Formulation of Light-Sensitive Layers

Numbers corresponding to respective ingredients represent coating amounts in terms of g/m$^2$, with silver halide being presented as the amount of coated silver. With sensitizing dyes and couplers, the amounts are presented in terms of mols per mol of silver halide in the same layer.

| | |
|---|---|
| First Layer: Antihalation Layer | |
| Black colloidal silver | 0.18 (silver) |
| Gelatin | 1.40 |
| Second Layer: Interlayer | |
| 2,5-Di-t-pentadecylhydroquinone | 0.18 |
| C-1 | 0.07 |
| C-3 | 0.02 |
| U-1 | 0.08 |
| U-2 | 0.08 |
| HBS-1 | 0.10 |
| HBS-2 | 0.02 |
| Gelatin | 1.04 |
| Third Layer: First Red-Sensitive Emulsion Layer | |
| Silver iodobromide emulsion | 0.50 (silver) |
| Sensitizing Dye IX | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| C-2 | 0.146 |
| HBS-1 | 0.005 |
| C-13 | 0.0050 |
| Gelatin | 1.20 |
| Fourth Layer: Second Red-Sensitive Emulsion Layer | |
| Silver iodobromide emulsion | 1.15 (silver) |
| Sensitizing Dye IX | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| C-2 | 0.060 |
| C-3 | 0.008 |
| C-13 | 0.004 |
| HBS-1 | 0.005 |
| Gelatin | 1.50 |
| Fifth Layer: Third Red-Sensitive Emulsion Layer | |
| Silver iodobromide emulsion | 1.50 (silver) |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| C-5 | 0.012 |
| C-3 | 0.003 |
| C-4 | 0.004 |
| HBS-1 | 0.32 |
| Gelatin | 1.63 |
| Sixth Layer: Interlayer | |
| Gelatin | 1.06 |
| Seventh Layer: First Green-Sensitive Emulsion Layer | |
| Silver iodobromide Emulsion | 0.35 (silver) |
| Sensitizing Dye V | $3.0 \times 10^{-5}$ |
| Sensitizing Dye VI | $1.0 \times 10^{-4}$ |

-continued

| | |
|---|---|
| Sensitizing Dye VII | $3.8 \times 10^{-4}$ |
| C-6 | 0.120 |
| C-1 | 0.021 |
| C-7 | 0.030 |
| C-8 | 0.025 |
| HBS-1 | 0.20 |
| Gelatin | 0.70 |
| Eighth Layer: Second Green-Sensitive Emulsion Layer | |
| Silver iodobromide emulsion | 0.75 (silver) |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| C-6 | 0.021 |
| C-8 | 0.004 |
| C-1 | 0.002 |
| C-7 | 0.003 |
| HBS-1 | 0.15 |
| Gelatin | 0.80 |
| Ninth Layer: Third Green-Sensitive Emulsion Layer | |
| Silver iodobromide emulsion | 1.80 (silver) |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| C-6 | 0.011 |
| C-1 | 0.001 |
| HBS-2 | 0.69 |
| Gelatin | 1.74 |
| Tenth Layer: Yellow Filter Layer | |
| Yellow colloidal silver | 0.05 (silver) |
| 2,5-Di-t-pentadecylhydroquinone | 0.03 |
| Gelatin | 0.95 |
| Eleventh Layer: First Blue-Sensitive Emulsion Layer | |
| Silver iodobromide emulsion | 0.24 (silver) |
| Sensitizing Dye VIII | $3.5 \times 10^{-4}$ |
| C-9 | 0.27 |
| C-8 | 0.005 |
| HBS-1 | 0.28 |
| Gelatin | 1.28 |
| Twelfth Layer: Second Blue-Sensitive Emulsion Layer | |
| Silver iodobromide emulsion | 0.45 (silver) |
| Sensitizing Dye VIII | $2.1 \times 10^{-4}$ |
| C-9 | 0.098 |
| HBS-1 | 0.03 |
| Gelatin | 0.46 |
| Thirteenth Layer: Third Blue-Sensitive Emulsion Layer | |
| Silver iodobromide emulsion | 0.77 (silver) |
| Sensitizing Dye VIII | $2.2 \times 10^{-4}$ |
| C-9 | 0.036 |
| HBS-1 | 0.07 |
| Gelatin | 0.69 |
| Fourteenth Layer: First Protective Layer | |
| Silver iodobromide emulsion (AgI: 1 mol %, average grain size: 0.07 μm) | 0.5 (silver) |
| U-1 | 0.11 |
| U-2 | 0.17 |
| HBS-1 | 0.90 |
| Fifteenth Layer: Second Protective Layer | |
| Polymethyl methacrylate particles (diameter: about 1.5 μm) | 0.54 |
| S-1 | 0.15 |
| S-2 | 0.10 |
| Gelatin | 0.72 |

Gelatin Hardener H-1 and a surfactant were added to each layer described above in addition to the above-described composition.

Structures of Compounds Used in Example 1

U-1
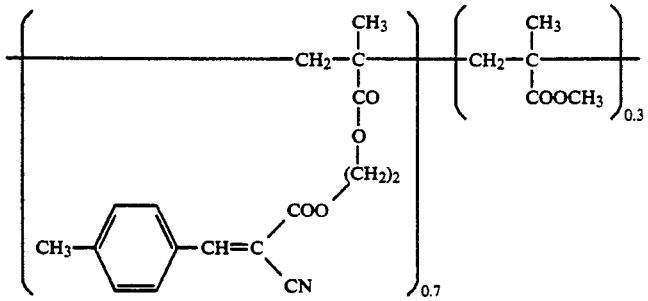
U-2
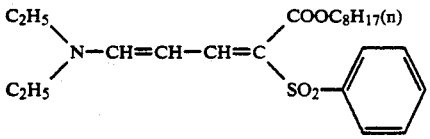
C-1
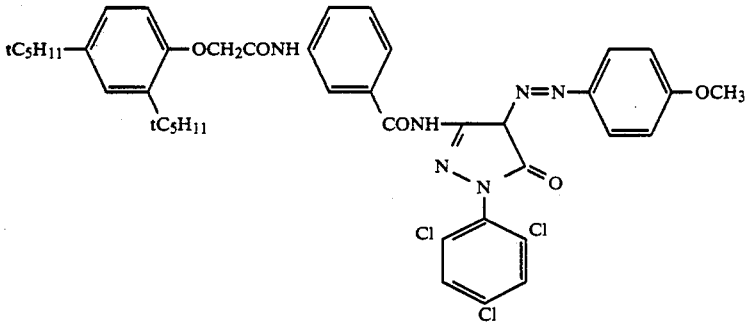
C-2
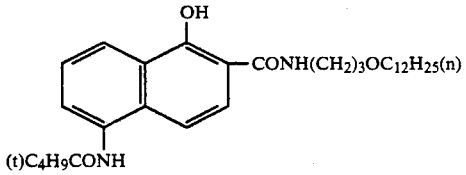
C-3
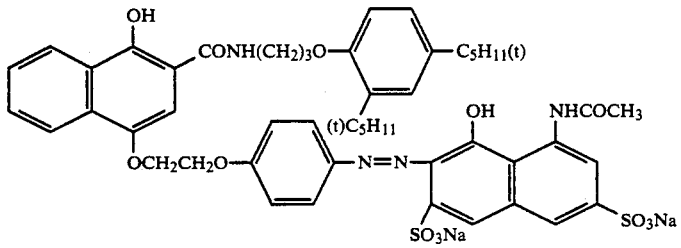
C-4
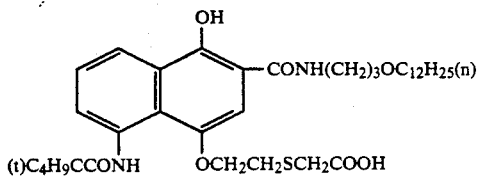

-continued
C-5
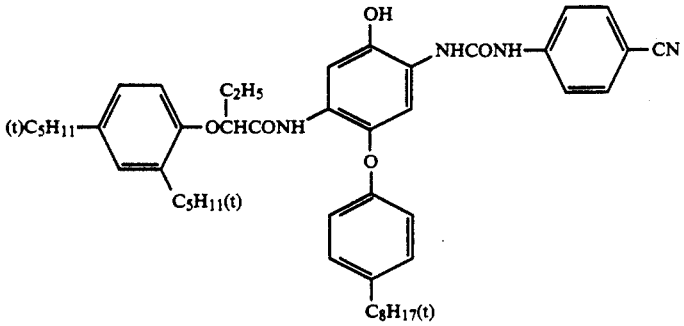
C-6
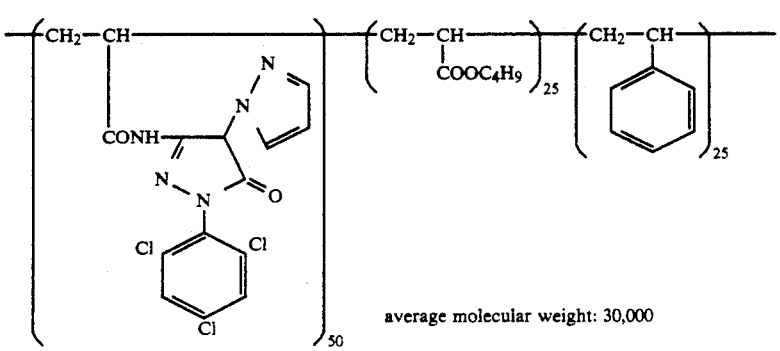
C-7
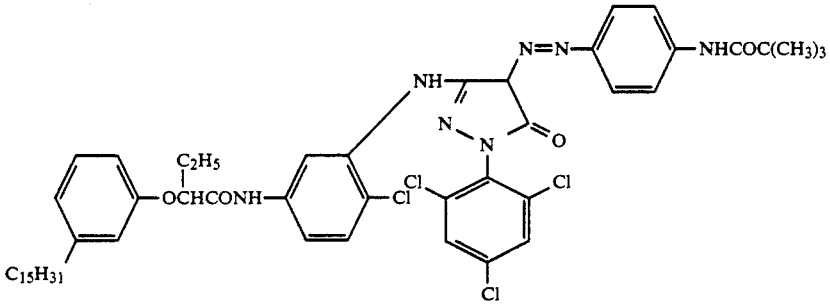
C-8
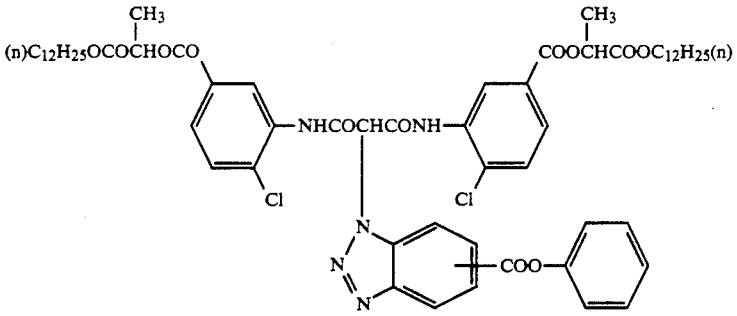
C-9
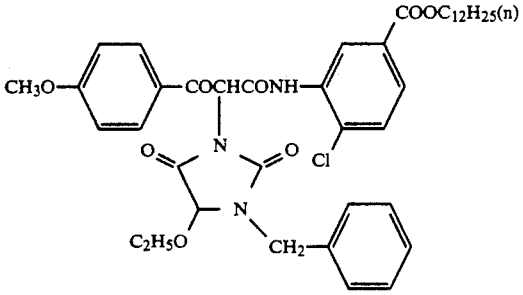

-continued
C-10
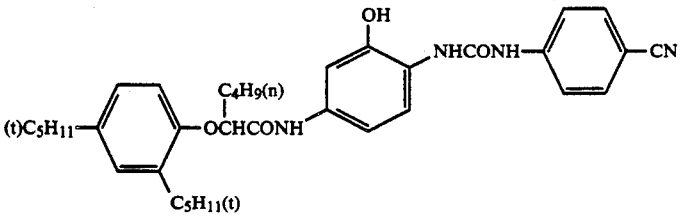
C-11
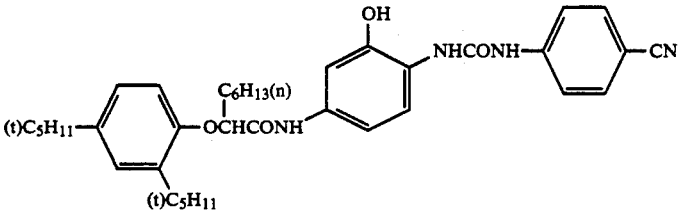
C-12
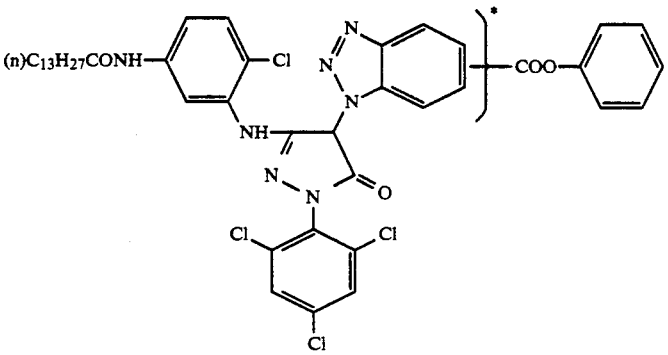
* wherein —COO— 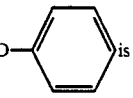 is attached to the 5-position or 6-position of benzotriazole
C-13
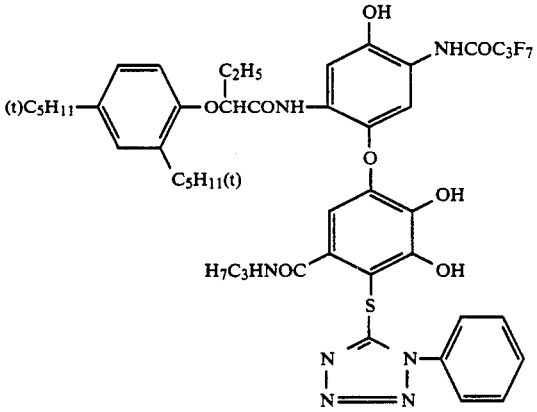
S-1
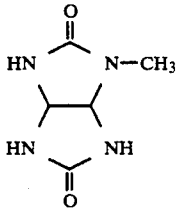

-continued
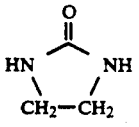
S-2
HBS-1: Tricresyl phosphate
HBS-2 Dibutyl phthalate
HBS-3: Tri-n-hexyl phosphate
H-1: $CH_2{=}CH{-}SO_2{-}CH_2CONH{-}CH_2$
$CH_2{=}CH{-}SO_2{-}CH_2CONH{-}CH_2$
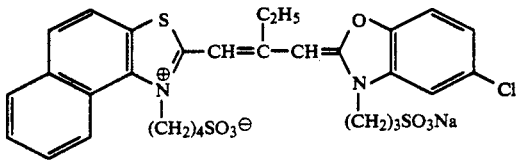
Sensitizing Dye I
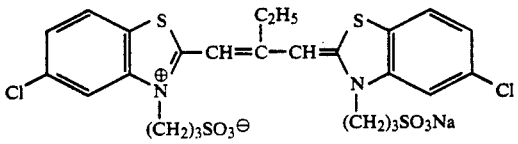
Sensitizing Dye II
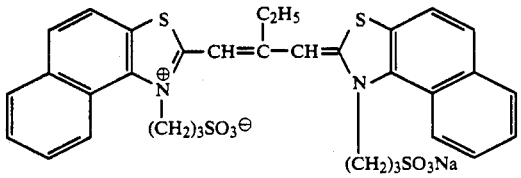
Sensitizing Dye III
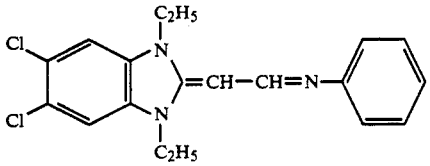
Sensitizing Dye IV
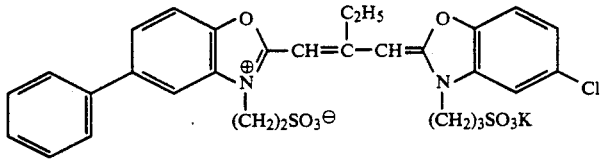
Sensitizing Dye V
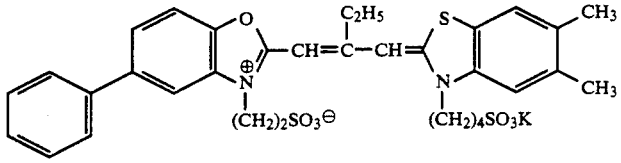
Sensitizing Dye VI
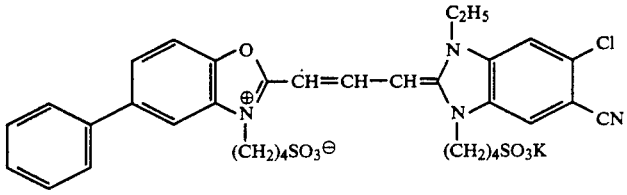
Sensitizing Dye VII -continued

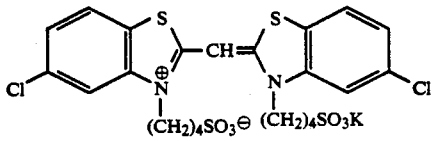

Sensitizing Dye VIII

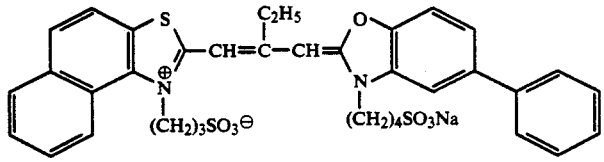

Sensitizing Dye IX

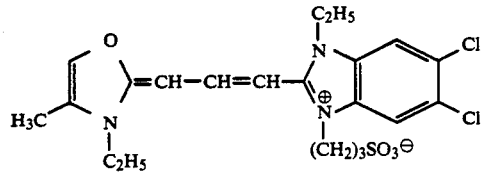

Sensitizing Dye X

Using this layer structure, Samples 101 to 110 were prepared by using Emulsions A to P shown in Table 1 as shown in Table 2.

below. Graininess of the thus-processed samples was evaluated based on RMS values obtained by measuring microdensity using a 48 μm aperture.

TABLE 1

| Emulsion | $\bar{r}$ (μm) | Weight of Grains Falling within ± 20% of $\bar{r}$ | Aspect Ratio | Form of Grains | AgI Content in Core (mol %) | AgI Content in Shell (mol %) | Volume of Core (%) |
|---|---|---|---|---|---|---|---|
| A | 0.5 | 45 | 3:1 | Twin crystals | Average AgI Content 4 mol % | | |
| B | 0.8 | 40 | 3:1 | " | Average AgI Content 6 mol % | | |
| C | 1.1 | 50 | 4:1 | " | Average AgI Content 13 mol % | | |
| D | 0.5 | 40 | 6:1 | Tabular | Average AgI Content 2 mol % | | |
| E | 0.7 | 35 | 7:1 | " | Average AgI Content 4 mol % | | |
| F | 1.0 | 40 | 7:1 | " | Average AgI Content 6 mol % | | |
| G | 0.6 | 50 | 3:1 | Twin crystals | Average AgI Content 6 mol % | | |
| H | 0.9 | 40 | 3:1 | " | Average AgI Content 10 mol % | | |
| I | 1.8 | 50 | 4:1 | " | Average AgI Content 13 mol % | | |
| J | 0.6 | 40 | 6:1 | Tabular | Average AgI Content 4 mol % | | |
| K | 0.8 | 35 | 7:1 | " | Average AgI Content 6 mol % | | |
| L | 1.5 | 40 | 7:1 | " | Average AgI Content 6 mol % | | |
| M | 0.5 | 90 | 1:1 | Octahedral | 15 | 0 | 40 |
| N | 0.9 | 90 | 1:1 | " | 30 | 0 | 50 |
| O | 1.5 | 90 | 1:1 | " | 40 | 1 | 40 |
| P | 1.5 | 90 | 1:1 | " | 20 | 1 | 40 |

TABLE 2

| Layer | Sample No. 101* | 102* | 103* | 104* | 105* | 106** | 107** | 108** | 109** | 110** |
|---|---|---|---|---|---|---|---|---|---|---|
| Third Layer (low light-sensitive) | A | A | A | A | A | A | A | A | A | A |
| Fourth Layer (medium light-sensitive) | B | B | B | B | B | B | B | B | B | B |
| Fifth Layer (high light-sensitive) | C | C | C | C | C | C | C | C | C | C |
| Seventh Layer (low light-sensitive) | A | A | A | A | A | A | A | A | A | D |
| Eighth Layer (medium light-sensitive) | B | B | B | B | B | B | B | B | B | E |
| Ninth Layer (high light-sensitive) | C | C | C | C | C | C | C | C | C | F |
| Eleventh Layer (low light-sensitive) | G | J | G | M | M | J | J | J | J | J |
| Twelfth Layer (medium light-sensitive) | H | H | H | H | H | H | H | K | N | N |
| Thirteenth Layer (high light-sensitive) | I | I | O | O | L | O | P | O | O | O |

*Comparative sample,
**Sample of the present invention

The thus-obtained Samples 101 to 110 were subjected to uniform exposure for 1/100 second using a white light of 4,800° K. and 5 lux, then developed as shown In order to evaluate color image sharpness, the MTF (Modulation Transfer Function) of the samples was determined by the method described in T. H. James, *The Theory of the Photographic Process*, 4th Ed., pages 604 to 607 (Macmillan Publishing Co., Inc., 1977), and sharpness was compared in terms of MTF values at 20 lines/mm as relative values (taking the value of Comparative Sample 101 as 100).

| Processing Step | Processing Time (38° C.) |
|---|---|
| Color Development | 3 min 15 sec |
| Bleaching | 6 min 30 sec |
| Washing with Water | 2 min 10 sec |
| Fixing | 4 min 20 sec |
| Washing with Water | 3 min 15 sec |
| Stabilizing | 1 min 05 sec |

Formulations of the processing solutions used in the processing steps were as follows.

| | |
|---|---|
| Color Developer: | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-β-hydroxyethylaminno)-2-methylaniline Sulfate | 4.5 g |
| Water to make | 1.0 liter |
| | pH 10.0 |
| Bleaching Solution: | |
| Ammonium Ethylenediaminetetraacetato Ferrate | 100.0 g |
| Disodium Ethylenediaminetetraacetate | 10.0 g |
| Ammonium Bromide | 150.0 g |
| Ammonium Nitrate | 10.0 g |
| Water to make | 1.0 liter |
| | pH 6.0 |
| Fixing Solution: | |
| Disodium Ethylenediaminetetraacetate | 1.0 g |
| Sodium Sulfite | 4.0 g |
| Ammonium Thiosulfate Aqueous Solution (70%) | 175.0 ml |
| Sodium Bisulfite | 4.6 liters |
| Water to make | 1.0 liter |
| | pH 6.6 |
| Stabilizing Solution: | |
| Formalin (40%) | 2.0 ml |
| Polyoxyethylene-p-monononylphenyl Ether (average polymerization degree: 10) | 0.3 g |
| Water to make | 1.0 liter |

TABLE 3

| Sample No. | Graininess (RMS Value) | | | Sharpness (MTF Value) | | |
|---|---|---|---|---|---|---|
| | B | G | R | B | G | R |
| 101* | 0.035 | 0.015 | 0.013 | 100 | 100 | 100 |
| 102* | 0.034 | 0.015 | 0.013 | 110 | 121 | 118 |
| 103* | 0.028 | 0.013 | 0.012 | 104 | 105 | 106 |
| 104* | 0.025 | 0.013 | 0.012 | 99 | 90 | 93 |
| 105* | 0.033 | 0.014 | 0.013 | 105 | 95 | 98 |
| 106** | 0.025 | 0.013 | 0.012 | 125 | 130 | 132 |
| 107** | 0.030 | 0.014 | 0.013 | 127 | 132 | 133 |
| 108** | 0.026 | 0.013 | 0.012 | 130 | 140 | 145 |
| 109** | 0.022 | 0.012 | 0.012 | 120 | 125 | 130 |
| 110** | 0.022 | 0.010 | 0.010 | 120 | 138 | 147 |

*Comparative sample,
**Sample of the present invention

As is clear from Table 3, remarkable improvements were observed with respect to sharpness and graininess by the combined use of the silver halide emulsions of the present invention. Sample 105, which contains a tabular emulsion in the more sensitive layer and a monodispersed emulsion in the less sensitive layer, is disclosed in Japanese Patent Application (OPI) No. 77847/86, but samples of the present invention (for example, Sample 106) have surprisingly better graininess and sharpness than Sample 105.

EXAMPLE 2

Layers having the following formulations were coated in order on a subbed Cellulose triacetate film support to prepare Multilayer Color Light-Sensitive Materials 201 to 204.

Formulation of Light-Sensitive Layer

Meaning of values and units are the same as in Example 1.

| | |
|---|---|
| First Layer: Antihalation Layer | |
| Black colloidal silver | 0.2 (silver) |
| Gelatin | 1.0 |
| UV Light Absorbent UV-1 | 0.2 |
| Dispersing oil, Oil-1 | 0.02 |
| Second Layer: Interlayer | |
| Fine grained silver bromide (mean grain size: 0.07 μm) | 0.15 (silver) |
| Gelatin | 1.0 |
| Third Layer: First Red-Sensitive Emulsion Layer | |
| Silver iodobromide emulsion | 0.7 (silver) |
| Gelatin | 0.9 |
| Sensitizing Dye A | $1.0 \times 10^{-4}$ |
| Sensitizing Dye B | $2.0 \times 10^{-4}$ |
| Coupler C-21 | 0.3 |
| Coupler C-22 | 0.3 |
| Coupler C-23 | 0.2 |
| Coupler C-24 | 0.02 |
| Coupler C-25 | 0.01 |
| Dispersing oil, Oil-1 | 0.1 |
| Dispersing oil, Oil-2 | 0.1 |
| Fourth Layer: Second Red-Sensitive Emulsion Layer | |
| Silver iodobromide emulsion | 1.0 (silver) |
| Gelatin | 1.0 |
| Sensitizing Dye A | $3 \times 10^{-4}$ |
| Sensitizing Dye B | $2 \times 10^{-4}$ |
| Coupler C-21 | 0.01 |
| Coupler C-22 | 0.05 |
| Coupler C-23 | 0.03 |
| Coupler C-26 | 0.01 |
| Coupler C-27 | 0.02 |
| Coupler C-28 | 0.02 |
| Coupler C-29 | 0.02 |
| Dispersing oil, Oil-2 | 0.1 |
| Fifth Layer: Interlayer | |
| Gelatin | 1.0 |
| Compound Cpd-A | 0.05 |
| Dispersing oil, Oil-2 | 0.05 |
| Sixth Layer: First Green-Sensitive Emulsion Layer | |
| Silver iodobromide emulsion | 0.6 (silver) |
| Gelatin | 1.0 |
| Sensitizing Dye C | $3 \times 10^{-4}$ |
| Sensitizing Dye D | $2 \times 10^{-4}$ |
| Coupler C-30 | 0.4 |
| Coupler C-31 | 0.1 |
| Coupler C-32 | 0.02 |
| Coupler C-36 | 0.01 |
| Dispersing oil, Oil-2 | 0.05 |
| Seventh Layer: Second Green-Sensitive Layer | |
| Silver iodobromide emulsion | 0.9 (silver) |
| Gelatin | 0.9 |
| Sensitizing Dye C | $2 \times 10^{-4}$ |
| Sensitizing Dye D | $1.5 \times 10^{-4}$ |
| Coupler C-32 | 0.08 |
| Coupler C-34 | 0.05 |
| Dispersing oil, Oil-1 | 0.08 |
| Dispersing oil, Oil-3 | 0.03 |
| Eighth Layer: Interlayer | |

-continued

| | |
|---|---|
| Gelatin | 1.2 |
| Compound Cpd-A | 0.6 |
| Dispersing oil, Oil-1 | 0.3 |
| Ninth Layer: Yellow Filter Layer | |
| Yellow colloidal silver | 0.2 (silver) |
| Gelatin | 0.8 |
| Compound Cpd-A | 0.2 |
| Dispersing oil, Oil-1 | 0.1 |
| Tenth Layer: First Blue-Sensitive Emulsion Layer | |
| Silver iodobromide emulsion | 0.8 (silver) |
| Gelatin | 1.0 |
| Sensitizing Dye E | $3 \times 10^{-4}$ |
| Sensitizing Dye F | $3 \times 10^{-4}$ |
| Coupler C-35 | 0.9 |
| Coupler C-36 | 0.05 |
| Dispersing oil, Oil-3 | 0.01 |
| Eleventh Layer: Second Blue-Sensitive Emulsion Layer | |
| Silver iodobromide emulsion | 0.5 (silver) |
| Gelatin | 0.5 |
| Sensitizing Dye E | $1 \times 10^{-4}$ |

-continued

| | |
|---|---|
| Sensitizing Dye F | $1 \times 10^{-4}$ |
| Coupler C-35 | 0.2 |
| Coupler C-36 | 0.05 |
| Dispersing oil, Oil-3 | 0.01 |
| Twelfth Layer: First Protective Layer | |
| Gelatin | 0.5 |
| Coupler C-36 | 0.1 |
| UV Light Absorbent UV-2 | 0.1 |
| UV Light Absorbent UV-3 | 0.2 |
| Dispersing oil, Oil-3 | 0.01 |
| Thirteenth Layer: Second Protective Layer | |
| Fine grained silver bromide (mean grain size: 0.07 μm) | 0.25 (silver) |
| Gelatin | 0.5 |
| Polymethyl methacrylate particles (diameter: 1.5 μm) | 0.2 |
| Formaldehyde Scavenger S-1 | 0.5 |

In addition, Surfactant W-1 and Hardener H-1 were added to each layer.

Sensitizing Dye A

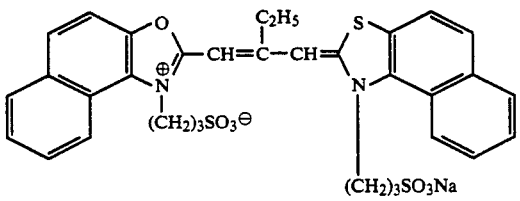

Sensitizing Dye B

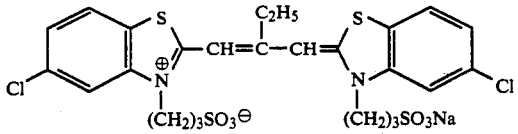

Sensitizing Dye C

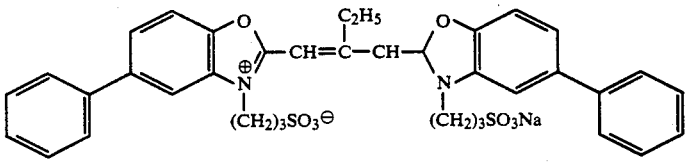

Sensitizing Dye D

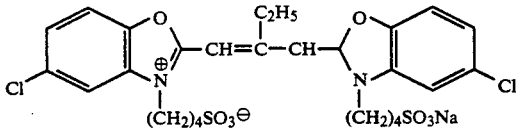

Sensitizing Dye E

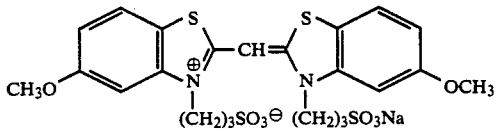

Sensitizing Dye F

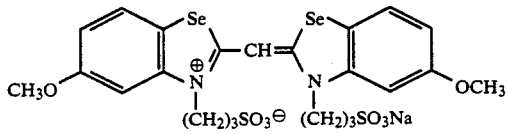

Coupler C-21

-continued
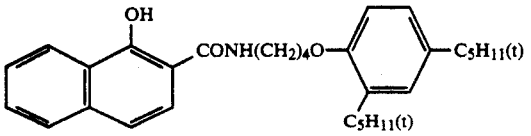
Coupler C-22
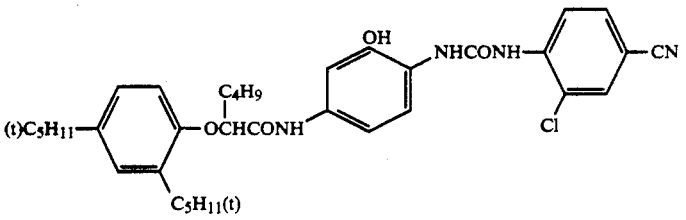
Coupler C-23
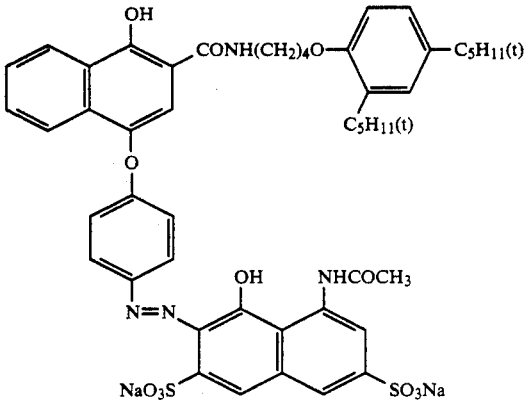
Coupler C-24
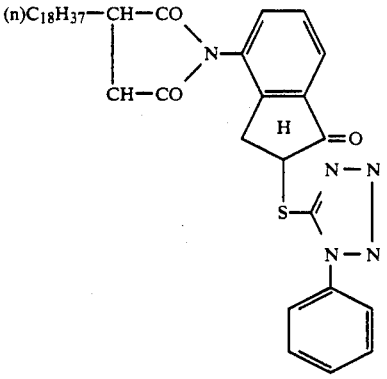
Coupler C-25
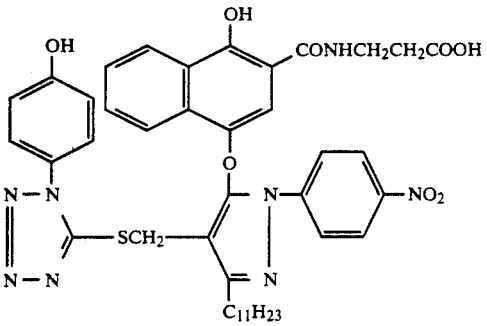
Coupler C-26

-continued
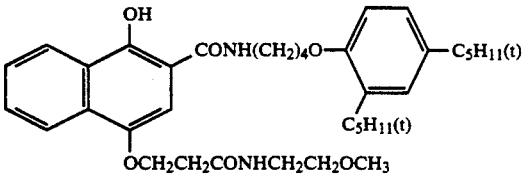
Coupler C-27
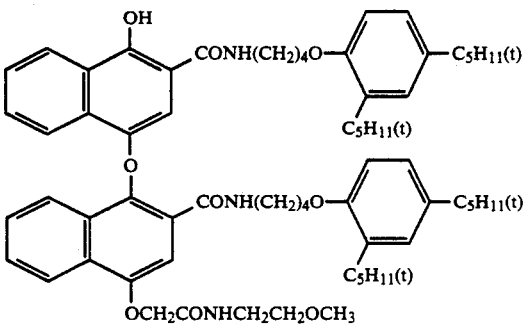
Coupler C-28
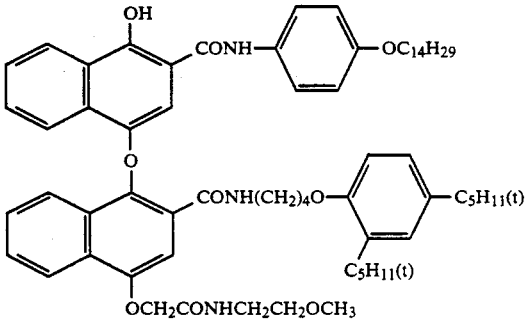
Coupler C-29
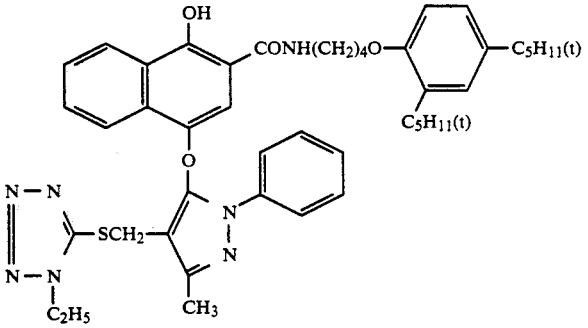
Coupler C-30
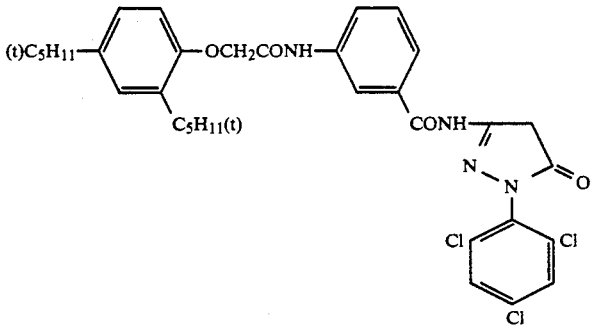
Coupler C-31

-continued
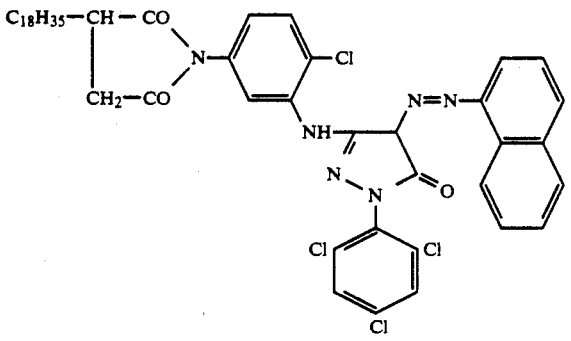
Coupler C-32
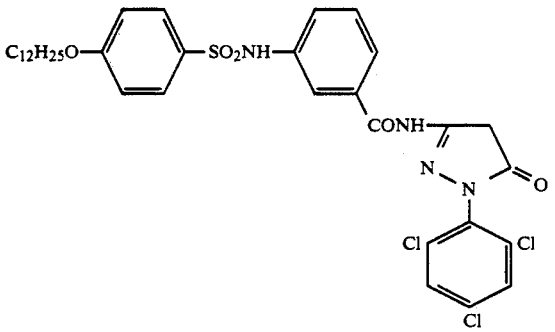
Coupler C-33
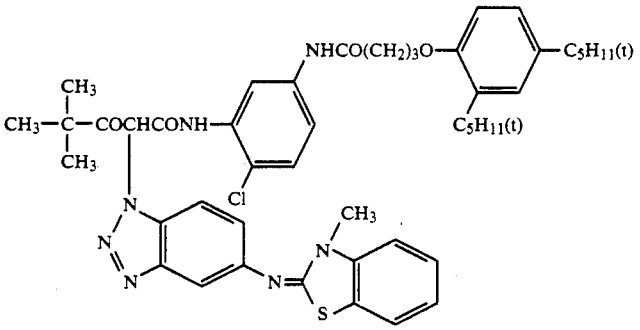
Coupler C-34
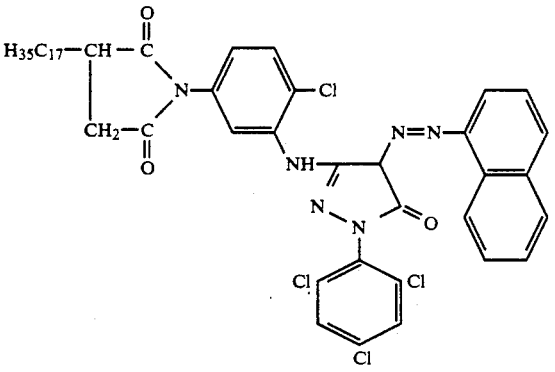
Coupler C-35

-continued
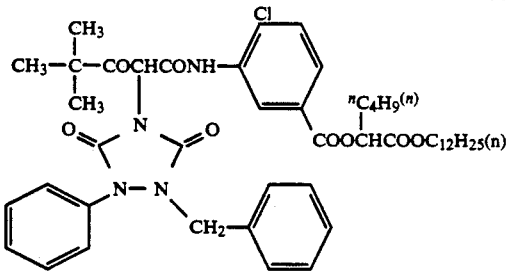
Coupler C-36
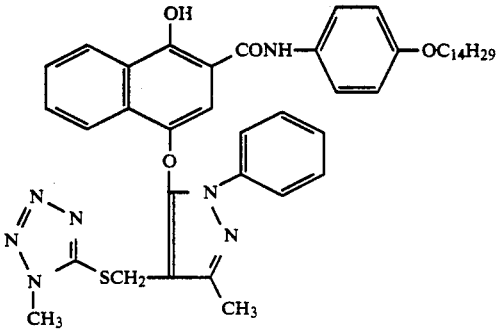
Surfactant W-1
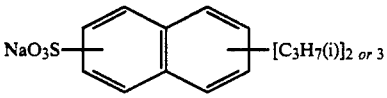
Formalin Scavenger S-1
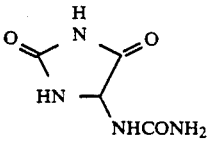
Dispersing Oil, Oil-1
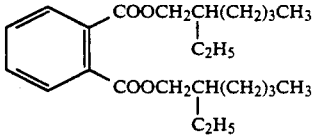
Dispersing Oil, Oil-2
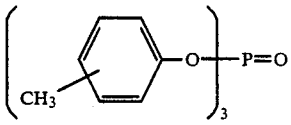
Dispersing Oil, Oil-3
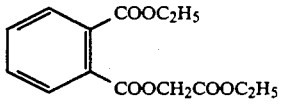
UV Light Absorbent UV-1
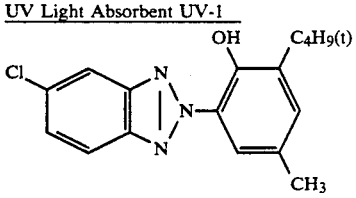

-continued

UV Light Absorbent UV-2

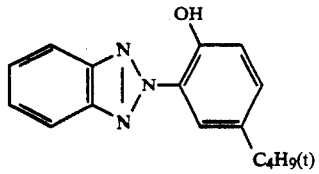

UV Light Absorbent UV-3

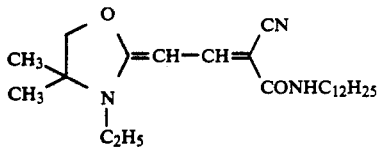

Compound Cpd-A

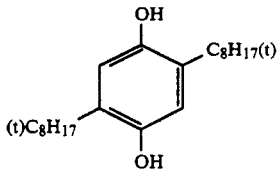

Samples 201 to 204 were prepared using Emulsions a to k shown in Table 4 in the manner shown in Table 5. The film thickness of each layer is as shown in Table 6.

These samples were exposed in the same manner as described in Example 1, then subjected to the development processing as shown below to measure the RMS values and MTF values as in Example 1 except that exposure for measuring RMS was changed to 2 lux. The results thus-obtained are tabulated in Table 7.

Development Processing Step

Development processing was conducted at 38° C. according to the following steps.

| | |
|---|---|
| Color Development | 3 min 15 sec |
| Bleach-Fixing | 1 min 15 sec |
| Rinsing | 2 min |
| Stabilizing | 40 sec |

The formulations of processing solutions used in the respective steps were as follows.

| | |
|---|---|
| Color Developer: | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-β-hydroxyethylamino)-2-methylaniline Sulfate | 4.5 g |
| Water to make | 1.0 liter |
| | pH 10.0 |
| Bleach-Fixing Solution: | |
| Ammonium Ethylenediaminetetraacetato Ferrate | 100.0 g |
| Disodium Ethylenediaminetetraacetate Dihydrate | 5.0 g |
| Sodium Sulfite | 10.0 g |
| Ammonium Thiosulfate Aqueous Solution (70%) | 220.0 ml |
| Water to make | 1.0 liter |
| | pH 6.9 |

-continued

| | |
|---|---|
| Rinsing Solution: | |
| Water | 1.0 liter |
| Disodium Ethylenediaminetetraacetate | 0.2 g |
| Sulfanylamide | 0.2 g |
| Stabilizing Solution: | |
| Formalin (37% w/v) | 2.0 ml |
| Polyoxyethylene-p-monononylphenyl Ether (average polymerization degree: 10) | 0.3 g |
| Water to make | 1 liter |

As is apparent from Table 7, Sample 202 of the present invention is superior to, for example, Sample 201 which is disclosed in Japanese Patent Application (OPI) No. 77847/86 in graininess and sharpness. Sample 203 in which tabular grains were absent in layers nearer to the support showed a larger MTF, particularly in the low frequency range, than Sample 202 in which tabular grains were used in layers nearer to the support, providing better sharpness. Further, Sample 204 (which uses a monodispersed grain in the outermost region of region A) without monodispersed grains in the layers of the region nearer to the support is inferior to a sample using monodispersed grains in this region, for example, Sample 203, in graininess.

TABLE 4

| Emulsion | $\bar{r}$ (μm) | Weight of Grains Falling within ±20% of r | Aspect Ratio | Form of Grains | Average AgI Content (mol %) |
|---|---|---|---|---|---|
| a | 0.4 | 45 | 2:1 | Twin crystals | 3 |
| b | 0.7 | 50 | 3:1 | Twin crystals | 8 |
| c | 0.7 | 40 | 7:1 | Tabular | 6 |
| d | 0.3 | 80 | 1:1 | Cubic | 3 |
| e | 0.5 | 85 | 1:1 | Cubic | 6 |
| f | 0.7 | 90 | 3:1 | Twin crystals | 8 |
| g | 0.5 | 35 | 7:1 | Tabular | 3 |
| h | 1.0 | 40 | 7:1 | Tabular | 6 |
| i | 0.3 | 80 | 1:1 | Octahedral | 6 |
| j | 0.6 | 85 | 1:1 | Octahedral | 6 |
| k | 1.1 | 90 | 1:1 | Octahedral | 15 |
| l | 0.5 | 45 | 2:1 | Twin crystals | 5 |

TABLE 4-continued

| Emulsion | $\bar{r}$ (μm) | Weight of Grains Falling within ±20% of $\bar{r}$ | Aspect Ratio | Form of Grains | Average AgI Content (mol %) |
|---|---|---|---|---|---|
| m | 1.2 | 50 | 3:1 | Twin crystals | 10 |

TABLE 5

| Layer | Sample No. 201* | 202** | 203** | 204** |
|---|---|---|---|---|
| Third Layer (low light-sensitive) | d, e (1:1 by wt) | d, e (1:1 by wt) | d, e (1:1 by wt) | a |
| Fourth Layer (high light-sensitive) | c | c | f | b |
| Sixth Layer (low light-sensitive) | d, e (1:1 by wt) | d, e (1:1 by wt) | d, e (1:1 by wt) | a |
| Seventh Layer (high light-sensitive) | c | c | c | c |
| Tenth Layer (low light-sensitive) | i, j (1:1 by wt) | g | g | g |
| Eleventh Layer (high light-sensitive) | h | k | k | k |

*Comparative sample,
**Sample of the present invention

TABLE 7

| Sample No. | Graininess (RMS value) B | G | R | Sharpness (MTF) 20 lines/mm (relative values) B | G | R | 5 lines/mm (relative values) B | G | R |
|---|---|---|---|---|---|---|---|---|---|
| 201 (Comparison) | 0.024 | 0.012 | 0.010 | 100 | 100 | 100 | 100 | 100 | 100 |
| 202 (Invention) | 0.017 | 0.011 | 0.009 | 120 | 130 | 132 | 105 | 113 | 115 |
| 203 (Invention) | 0.017 | 0.011 | 0.009 | 121 | 131 | 133 | 106 | 109 | 106 |
| 204 (Invention) | 0.017 | 0.011 | 0.013 | 120 | 129 | 122 | 105 | 110 | 109 |

EXAMPLE 3

Sample 301 was prepared by replacing Coupler C-36 used in the sixth, tenth and eleventh layers of Sample 201 in Example 2 with Coupler C-33 in equimolar amounts. Sample 302 was similarly prepared by replacing Coupler C-36 used in the sixth, tenth and eleventh layers of Samples 202 in Example 2 with Coupler C-33 in equimolar amounts.

Samples 201, 301, 202 and 302 were respectively exposed and developed in the same manner as described in Example 2 and the MTF values thereof were measured. The results thus obtained are shown in Table 8.

As is apparent from Table 8, Sample 201 using timing type DIR Coupler C-36, having a coupling-off group with a large diffusibility, is superior to Sample 301 containing C-33 in sharpness, and Sample 202 had a better MTF value than Sample 302. The sharpness improvement provided by the present invention is more remarkable in the samples using DIR Coupler C-36.

TABLE 8

| Sample No. | Sharpness (MTF) 20 lines/mm (relative values) B | G | R | 5 lines/mm (relative values) B | G | R |
|---|---|---|---|---|---|---|
| 201 | 100 | 100 | 100 | 100 | 100 | 100 |
| 301 | 97 | 96 | 98 | 92 | 91 | 93 |
| 202 | 120 | 130 | 132 | 105 | 113 | 115 |
| 302 | 115 | 124 | 128 | 96 | 102 | 106 |

EXAMPLE 4

Multilayer Color Light-Sensitive Materials 401 to 403 were prepared by coating in sequence the layers of the following formulation on a subbed cellulose triacetate film support.

Formulation of Light-Sensitive Layer

The respective ingredients have the same definition as in Example 1.

| | |
|---|---|
| First Layer: Antihalation Layer | |
| Black colloidal silver | 0.15 (silver) |
| U-1 | 0.5 |
| U-2 | 0.2 |
| HBS-3 | 0.4 |
| Gelatin | 1.5 |
| Second Layer: Interlayer | |
| C-7 | 0.10 |
| C-3 | 0.11 |
| 2,5-Di-t-octylhydroquinone | 0.05 |
| HBS-1 | 0.10 |
| Gelatin | 1.50 |
| Third Layer: First Red-Sensitive Emulsion Layer | |
| Silver iodobromide emulsion | 0.9 (silver) |
| C-10 | 0.35 |
| C-11 | 0.37 |
| C-3 | 0.12 |
| C-13 | 0.052 |
| HBS-3 | 0.30 |
| Sensitizing Dye I | $4.5 \times 10^{-4}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| Gelatin | 1.50 |
| Fourth Layer: Second Red-Sensitive Emulsion Layer | |
| Silver iodobromide emulsion | 1.0 (silver) |
| Sensitizing Dye I | $3.0 \times 10^{-4}$ |
| Sensitizing Dye II | $1.0 \times 10^{-5}$ |
| Sensitizing Dye III | $1.5 \times 10^{-4}$ |
| Sensitizing Dye IV | $2.0 \times 10^{-5}$ |
| C-4 | 0.078 |
| C-3 | 0.045 |
| HBS-1 | 0.010 |
| Gelatin | 0.80 |
| Fifth Layer: Interlayer | |
| 2,5-Di-t-octylhydroquinone | 0.12 |
| HBS-1 | 0.20 |
| Gelatin | 1.0 |
| Sixth Layer: First Green-Sensitive Emulsion Layer | |
| Silver iodobromide emulsion | 0.5 (silver) |
| Sensitizing Dye V | $6.0 \times 10^{-5}$ |
| Sensitizing Dye VI | $2.0 \times 10^{-4}$ |
| Sensitizing Dye VII | $4.0 \times 10^{-4}$ |
| C-6 | 0.27 |
| C-1 | 0.072 |
| C-7 | 0.12 |
| C-8 | 0.010 |
| HBS-1 | 0.15 |
| Gelatin | 0.70 |
| Seventh Layer: Second Green-Sensitife Emulsion Layer | |
| Silver iodobromide emulsion | 0.80 (silver) |
| Sensitizing Dye V | $4.0 \times 10^{-5}$ |
| Sensitizing Dye VI | $1.5 \times 10^{-4}$ |

-continued

| | |
|---|---|
| Sensitizing Dye VII | $3.0 \times 10^{-4}$ |
| C-6 | 0.071 |
| C-1 | 0.021 |
| C-7 | 0.016 |
| HBS-2 | 0.10 |
| Gelatin | 0.91 |
| Eighth Layer: Interlayer | |
| 2,5-Di-t-octylhydroquinone | 0.05 |
| HBS-2 | 0.10 |
| Gelatin | 0.70 |
| Ninth Layer: Emulsion Layer | |
| Silver iodobromide emulsion | 0.40 (silver) |
| Sensitizing Dye X | $5.0 \times 10^{-4}$ |
| C-8 | 0.051 |
| C-12 | 0.095 |
| HBS-1 | 0.15 |
| HBS-2 | 0.15 |
| Gelatin | 0.60 |
| Tenth Layer: Yellow Filter Layer | |
| Yellow colloidal silver | 0.85 (silver) |
| 25-Di-t-octylhydroquinone | 0.15 |
| HBS-1 | 0.20 |
| Gelatin | 0.80 |
| Eleventh Layer: First Blue-Sensitive Emulsion Layer | |
| Silver iodobromide emulsion | 0.35 (silver) |
| Sensitizing Dye VIII | $7.0 \times 10^{-4}$ |
| C-9 | 1.10 |
| C-8 | 0.050 |
| HBS-1 | 0.40 |
| Gelatin | 1.5 |
| Twelfth Layer: Second Blue-Sensitive Emulsion Layer | |
| Silver iodobromide emulsion | 0.5 (silver) |
| Sensitizing Dye VIII | $1.5 \times 10^{-4}$ |
| C-9 | 0.31 |
| HBS-1 | 0.12 |
| Gelatin | 0.88 |
| Thirteenth Layer: Interlayer | |
| U-1 | 0.12 |
| U-2 | 0.16 |
| HBS-3 | 0.12 |
| Gelatin | 0.75 |
| Fourteenth Layer: Protective Layer | |
| Silver iodobromide emulsion (AgI: 4 mol %, variation coefficient with grain size: 10%, average grain size: 0.08 μm) | 0.15 (silver) |
| Polymethyl methacrylate particles (diameter: 1.5 μm) | 0.2 |
| S-1 | 0.05 |
| S-2 | 0.15 |
| Gelatin | 0.80 |

In addition to the above-described ingredients, a surfactant and Gelatin Hardener H-1 were added to each layer.

Samples 401 to 403 were prepared using the emulsions shown in Table 4 in the manner shown in Table 9.

These samples were exposed and developed in the same manner as in Example 1 and the RMS values and MTF values thereof were determined. The exposure for measuring RMS was conducted at 2 lux. The results thus-obtained are shown in Table 10.

In the layer structure of Example 4, samples according to the present invention also displayed excellent graininess and sharpness.

TABLE 9

| Layer | Sample No. 401 (comparison) | 402 (Invention) | 403 (Invention) |
|---|---|---|---|
| Third Layer (low light-sensitive) | a | a | a |
| Fourth Layer (high light-sensitive) | b | b | b |
| Sixth Layer (low light-sensitive) | a | a | a |
| Seventh Layer (high light-sensitive) | b | b | b |
| Ninth Layer | a, f (1:1 by wt) | a, f (1:1 by wt) | c |
| Eleventh Layer (low light-sensitive) | l | g | g |
| Twelfth Layer (high light-sensitive) | m | k | k |

TABLE 10

| Sample No. | Graininess (RMS values) B | G | R | Sharpness (MTF) 20 lines/mm (relative value) B | G | R |
|---|---|---|---|---|---|---|
| 401* | 0.029 | 0.013 | 0.014 | 100 | 100 | 100 |
| 402** | 0.017 | 0.013 | 0.014 | 123 | 128 | 125 |
| 403** | 0.017 | 0.013 | 0.014 | 121 | 133 | 132 |

*Comparative sample
**Sample of the present invention

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon a layer structure:

BH/BM/BL/GH/GM/GL/RH/RM/RL/S wherein B represents a blue-sensitive layer, G represents a green-sensitive layer, R represents a red-sensitive layer, H represents the most sensitive layer, M represents a medium sensitivity layer, L represents a low sensitivity layer, and S represents a support, said BH containing a silver halide emulsion comprising substantially monodispersed silver halide grains, in which about 60% or more of all silver halide grains by weight have a size falling within the range of about +20% of the average grain size r, at least said BL containing a silver halide emulsion comprising tabular silver halide grains having an average aspect ratio of at least about 5:1, and wherein tabular silver grains are not used in RH and RL.

2. The silver halide photographic material of claim 1, wherein said tabular silver halide grains are also used in GH and/or GL.

3. The silver halide photographic material of claim 1, wherein said GH contains tabular grains and said RH contains monodispersed grains.

4. The silver halide photographic material of claim 1, wherein the average grain size of said monodispersed silver halide grains exceeds about 0.8 μm.

5. The silver halide photographic material of claim 1, wherein said monodispersed silver halide grains comprise an emulsion in which about 70% or more of all silver halide grains by weight have a size falling within the range of about ±20% of the average grain size.

6. The silver halide photographic material of claim 1, wherein said monodispersed silver halide grains are core/shell type grains.

7. The silver halide photographic material of claim 6, wherein said core/shell type grains are those which have a grain structure containing two or more layers different from each other in silver iodide content, with the outermost layer (shell portion) having a lower silver iodide content than the inner layers (core portion).

8. The silver halide photographic material of claim 7, wherein the silver iodide content in the core portion ranges from about 15 to 40 mol %.

9. The silver halide photographic material of claim 7, wherein the silver iodide content in the shell portion ranges from about 0.5 to 4.0 mol %.

10. The silver halide photographic material of claim 1, wherein said tabular silver halide grains have an aspect ratio of about 5 to 100.

11. The silver halide photographic material of claim 1, wherein said tabular silver halide grains have a diameter of about 1.0 to 10.0 μm.

12. The silver halide photographic material of claim 1, wherein said tabular silver halide grains have a silver iodide content of from about 4 to 10 mol %.

* * * * *